US007874929B2

(12) United States Patent
Blanchard et al.

(10) Patent No.: US 7,874,929 B2
(45) Date of Patent: Jan. 25, 2011

(54) SYSTEM AND METHOD FOR TRAINING A GOLF CLUB STROKE

(75) Inventors: Ralph J. Blanchard, Melbourne, FL (US); James Amato, St. Cloud, FL (US)

(73) Assignee: Accuputt International, Inc., Melbourne, FL (US)

( * ) Notice: Subject to any disclaimer, the term of this patent is extended or adjusted under 35 U.S.C. 154(b) by 515 days.

(21) Appl. No.: 11/840,676

(22) Filed: Aug. 17, 2007

(65) Prior Publication Data

US 2008/0248890 A1 Oct. 9, 2008

Related U.S. Application Data

(60) Provisional application No. 60/910,452, filed on Apr. 5, 2007.

(51) Int. Cl.
*A63B 69/36* (2006.01)

(52) U.S. Cl. ..... 473/222; 473/151; 473/257

(58) Field of Classification Search ..... 473/151, 473/198–225, 250, 257
See application file for complete search history.

(56) References Cited

U.S. PATENT DOCUMENTS

| | | | | |
|---|---|---|---|---|
| 3,801,108 | A * | 4/1974 | Murray | 473/225 |
| 3,873,094 | A * | 3/1975 | Sebo et al. | 473/250 |
| 3,885,796 | A | 5/1975 | King | |
| 3,894,739 | A | 7/1975 | Goldstein | |
| 4,342,455 | A * | 8/1982 | Miyamae | 473/222 |
| 4,342,456 | A * | 8/1982 | Miyamae | 473/222 |
| 5,246,233 | A | 9/1993 | Sheltman et al. | |
| 5,282,627 | A | 2/1994 | Beck | |
| 5,435,547 | A | 7/1995 | Lee | |
| 5,527,041 | A | 6/1996 | Terry, III et al. | |
| 5,718,639 | A * | 2/1998 | Bouton | 473/151 |
| 5,776,007 | A | 7/1998 | Kendall et al. | |
| 5,833,549 | A * | 11/1998 | Zur et al. | 473/199 |
| 6,159,106 | A | 12/2000 | Adams | |
| 6,458,038 | B1 | 10/2002 | Lin | |
| 6,669,574 | B1 | 12/2003 | Riley et al. | |
| 6,821,211 | B2 * | 11/2004 | Otten et al. | 473/219 |
| 6,878,071 | B1 * | 4/2005 | Schwieger et al. | 473/284 |
| 6,893,356 | B2 | 5/2005 | Thompson | |
| 6,929,557 | B2 | 8/2005 | Chou | |
| 6,997,817 | B1 | 2/2006 | Consiglio | |
| 7,134,966 | B1 | 11/2006 | Tice | |
| 7,214,146 | B1 | 5/2007 | Gersang | |
| 2006/0183565 | A1 | 8/2006 | Tolson et al. | |

FOREIGN PATENT DOCUMENTS

| | | |
|---|---|---|
| WO | WO 2006 117547 | 9/2006 |

* cited by examiner

*Primary Examiner*—Nini Legesse
(74) *Attorney, Agent, or Firm*—Cian O'Brien; John DeAngelis; Beusse Wolter Sanks Mora and Maire, P.A.

(57) ABSTRACT

A system is provided for training a golf club stroke. The system includes a sensor, and a transmitter positioned in a spaced relation to the sensor, where the transmitter transmits a signal received by the. The system further includes a golf club including a head including a transparent medium region, where the head is positioned between the sensor and the transmitter. The signal passes through the transparent medium region.

10 Claims, 7 Drawing Sheets

SYSTEM AND METHOD FOR TRAINING A GOLF CLUB STROKE

CROSS-REFERENCE TO RELATED APPLICATIONS

This application claims the benefit of U.S. Provisional Patent Application No. 60/910,452, filed Apr. 5, 2007, which is incorporated herein by reference.

FIELD OF THE INVENTION

This invention relates to golf putters, and more particularly to a system and method for training a golf club stroke.

BACKGROUND OF THE INVENTION

Golf is a game that requires accuracy with every club in order to achieve low scores. A low score, or low handicap, is essentially the goal of most active golfers. The golf putter is the golf club which is used when the golf ball is on the green and is closest to the hole. Typically, a golfer will use two or more strokes while putting the ball on the green. Thus, the golf putter is the most often used golf club and consequently, offers the best opportunity to lower the golfer's score or overall handicap.

After lining up a putt at an intended target, such as the hole or a slope adjacent to the hole in order to execute an effective putt at the intended target, the golfer must execute a correct golf putting stroke. A correct golf putting stroke involves a straight take-away along the intended target line, and a straight follow-through, also along the intended target line. Although a correct golf putting stroke can involve some minimal natural arc in the take-away and follow-through portions of the stroke, it should essentially follow the intended target line.

Thus, it would be advantageous to provide a system to improve both the accuracy and consistency of a golf club stroke, such that his/her score can be reduced to the maximum extent possible.

BRIEF DESCRIPTION OF THE INVENTION

One embodiment of the present invention provides a system for training a golf club stroke. The system includes a coupling member having a first portion and a second portion spaced apart from the first portion. More particularly, a sensor is coupled to the second portion, and is aligned for receiving a signal transmitted from a transmitter coupled to the first portion. The system further includes a putter including a head having a transparent medium region, in which the head is positioned on the coupling member between the first and second portions.

Another embodiment of the present invention provides a system for training a golf putting stroke. The system includes a sensor, and a transmitter configured to transmit a signal received by the sensor. Additionally, the system includes a putter including a head having a non-transparent medium region and a transparent medium region disposed between the non-transparent medium region. During a correct putting stroke of the putter, the signal is transmitted through the transparent medium region to the sensor. During an incorrect putting stroke of the putter, the signal is obstructed by the non-transparent medium region from being transmitted to the sensor.

Another embodiment of the present invention provides a method for training a golf putting stroke. The method includes providing a coupling member including a first end and a second end. More particularly, the method includes coupling a sensor to the second end, and coupling a transmitter to the first end. Additionally, the method includes transmitting a signal from the transmitter along the coupling member to the sensor. The method further includes positioning a putter including a head having an opening defined by the head on the coupling member.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
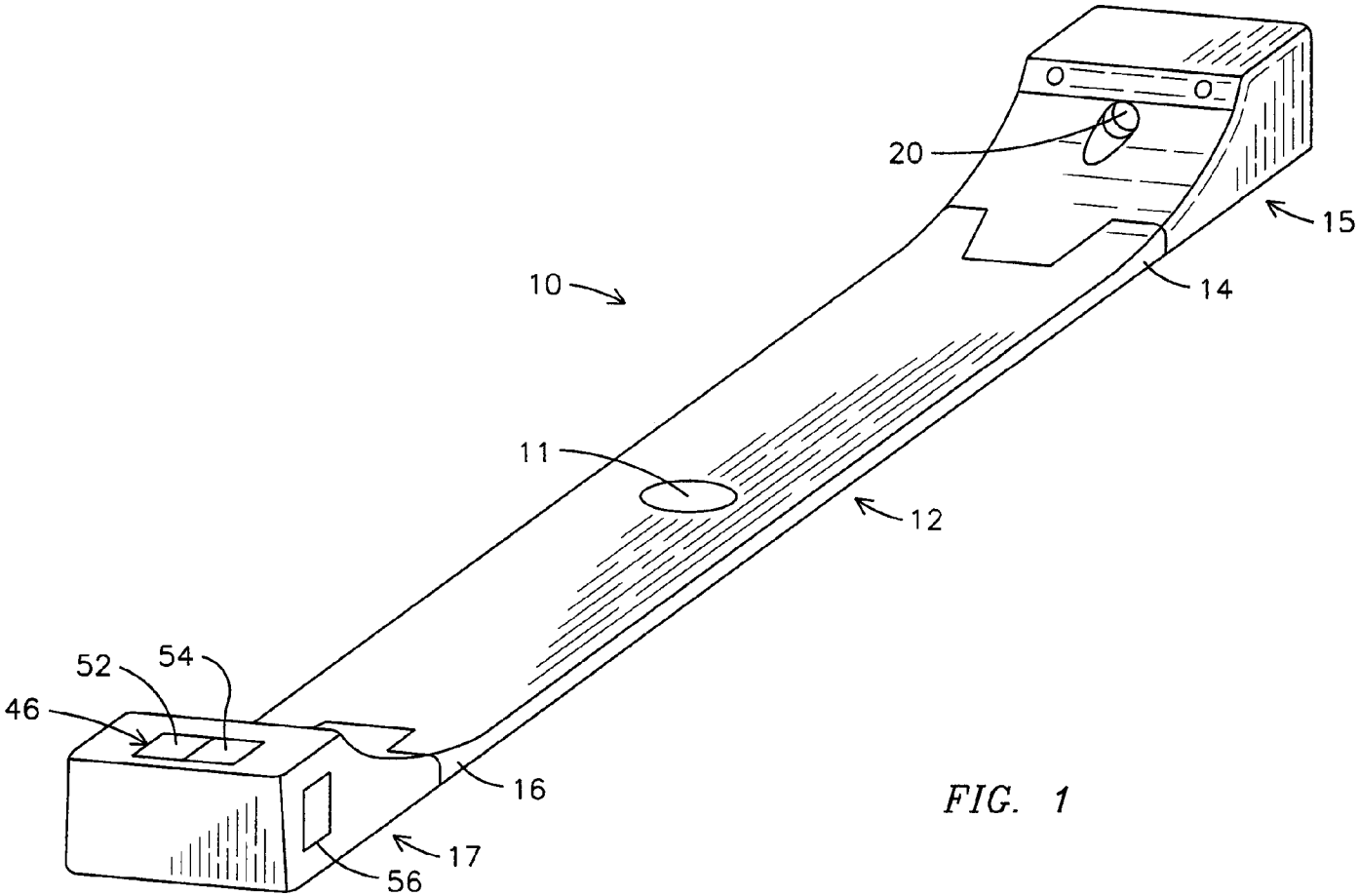
FIG. 1 depicts a top perspective view of an exemplary embodiment of a system for training a golf club stroke.
Figure 2:
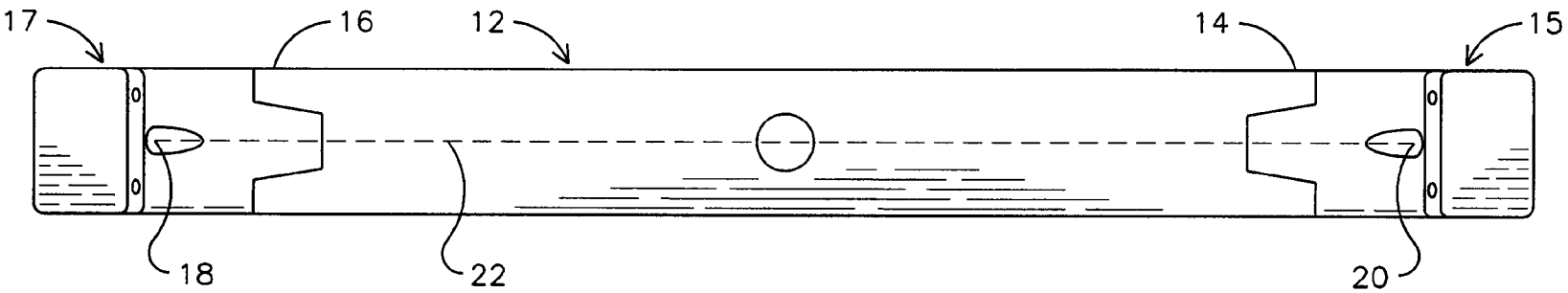
FIG. 2 depicts a plan top view of an exemplary embodiment of a system for training a golf club stroke.
Figure 3:
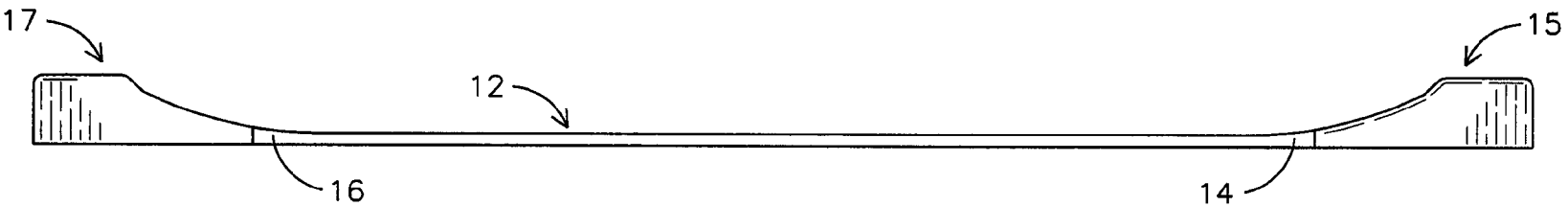
FIG. 3 depicts a plan side view of an exemplary embodiment of a system for training a golf club stroke.
Figure 4:
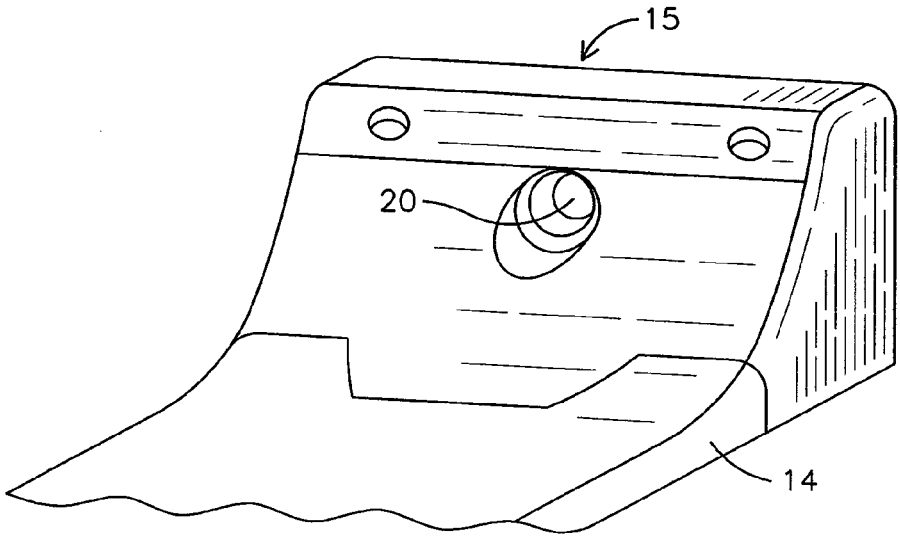
FIG. 4 depicts a side perspective view of an exemplary embodiment of a transmitter used in a system for training a golf club stroke.

Reference will now be made in detail to the embodiments consistent with the invention, examples of which are illustrated in the accompanying drawings. Wherever possible, the same reference numerals used throughout the drawings refer to the same or like parts.

FIG. 1 illustrates an exemplary embodiment of a system 10 for training a golf club stroke. The system 10 includes a coupling member 12 which extends along a flat ground or floor surface. Although the coupling member 12 of the exemplary embodiment of the system 10 illustrated in FIG. 1 is extended along a flat indoor surface, other embodiments of the system may include a coupling member which extends along a flat outdoor surface, for example. While the illustrated coupling member 12 has a larger length than width, the coupling member is not limited to this configuration. The width of the coupling member 12 is greater than the width of a typical golf putter head, however the width of the coupling member may be smaller than the width of a typical golf putter head. In an exemplary embodiment, the coupling member is approximately 48 inches long and 5 inches wide, for example. As discussed in an embodiment of the present invention, the coupling member 12 is an optional component of the system.

As further illustrated in FIGS. 1-4, the coupling member 12 includes a first end 14 and a second end 16 which are those opposing ends of the length of the coupling member 12. A first housing 15 is coupled to the first end 14, while a second housing 17 is coupled to the second end 16 of the coupling member 12. Although FIGS. 1-4 illustrate the first housing coupled to the first end 14, and the second housing 17 coupled to the second end 16 of the coupling member 12, the first housing and second housing may be respectively coupled to any first portion and second portion along the coupling member, other than the first and second end, provided that such placement is consistent with those other aspects of the present invention discussed below. Additionally, although FIGS. 1-4 illustrate a first housing 15 and a second housing 17, the system need not include a first housing or a second housing, as discussed in further detail below.

A laser sensor 18 is positioned within the second housing 17 that is coupled to the second end 16 of the coupling member 12. Additionally, a laser 20 is positioned within the first housing 15 that is coupled to the first end 14 of the coupling member 12. In an exemplary embodiment, the laser may be a class 1 or class 2 laser source, for example. Although the laser sensor and laser are respectively positioned within their respective second and first housings which are respectively coupled to the second and first ends of the coupling member, the laser sensor and laser need not be positioned within their individual housings, and instead may be individually coupled to the respective second end and first end of the coupling member, or to any respective second and first portion of the coupling member, provided that such positions are consistent with other aspects of the present invention, as discussed below. The laser 20 is configured to transmit a discrete laser beam 22 along the coupling member 12 to the laser sensor 18. Although the illustrated exemplary embodiments of FIGS. 1-4 illustrates a laser sensor, laser and laser beam, any sensor, transmitter and signal, of any frequency produced by the transmitter may be utilized which is capable of being received by a sensor and which is sufficiently collimated along the coupling member so to be utilized in accordance with the present invention, as discussed below. The laser 20 and laser sensor 18 may be powered using a plurality of batteries placed within a battery housing within the coupling member 12, the first housing 15, or the second housing 17, or alternatively by a common 110 volt external electrical source.

Figure 5:
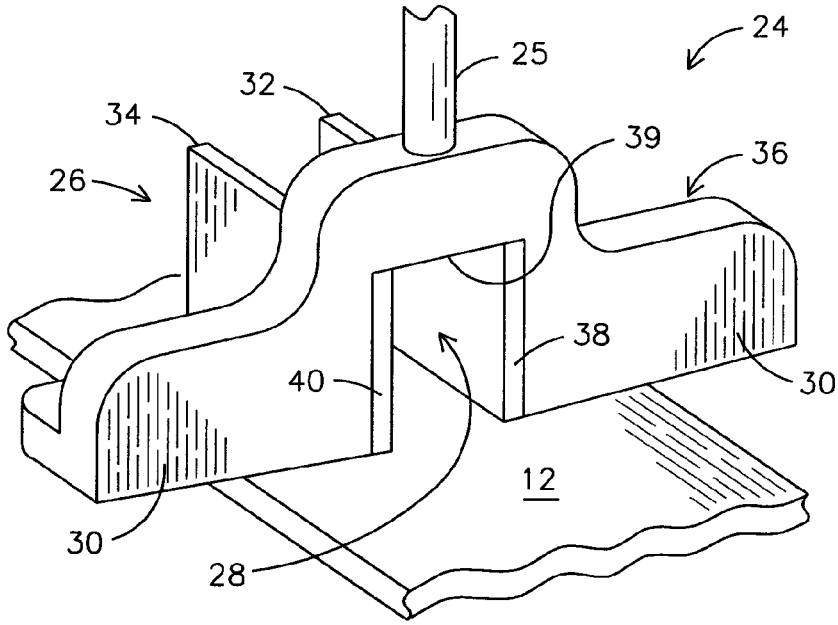
FIG. 5 depicts a front perspective view of an exemplary embodiment of a putter used in a system for training a golf club stroke.

As illustrated in the exemplary embodiment of FIG. 5, the system 10 further includes a putter 24 including a shaft 25 and a head 26 coupled to one end opposite to the end of the shaft onto which the grip is wrapped, as appreciated by one of skill in the art. The putter 24 preferably meets PGA® weight and balance standards, however the putter need not meet such standards. The head 26 is positioned on the coupling member 12, and includes an opening 28 defined by a pair of outside edges 38,40 (discussed below), a top edge 39, and the base of the coupling member 12 when the putter is positioned on the coupling member. Although the opening 28 has a rectangular shape, the opening may take any shape, provided that such shape conforms to the aspects of the present invention discussed below. Additionally, the opening 28 illustrated in FIG. 5 may be filled with any transparent medium, such as air, glass, or any similar material which is capable of transmitting radiation, particularly laser radiation. As appreciated by one of skill in the art, although a transparent medium such as glass would reflect a portion of radiation such as a laser beam from its surface, another portion of the laser beam would transmit through the transparent medium.

The opening 28 has an adjustable width, defined by the separation of the outside edges 38,40, based upon the separation of the shield structures 32,34, as described below. However, the opening may have any adjustable dimension other than its width. The separation of the outside edges 38,40 is variable, either manually or automatically (the outside edges may be coupled to an automatically controlled device), and each outside edge 38,40 extends away from a rear face 36 of head 26 to form a pair of shield bases 33,35, as described below.

Figure 6:
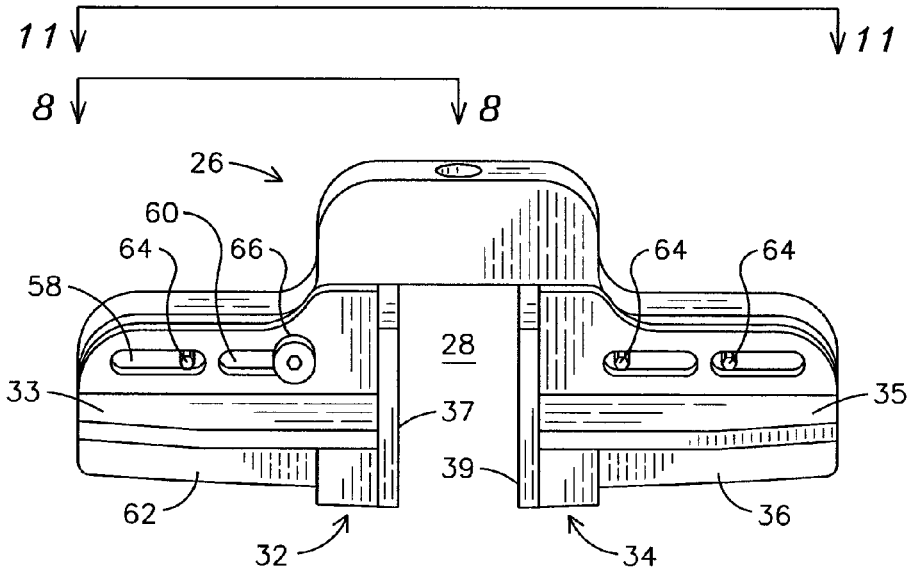
FIG. 6 depicts a rear elevational view of an exemplary embodiment of a putter head used in a system for training a golf club stroke.
Figure 7:
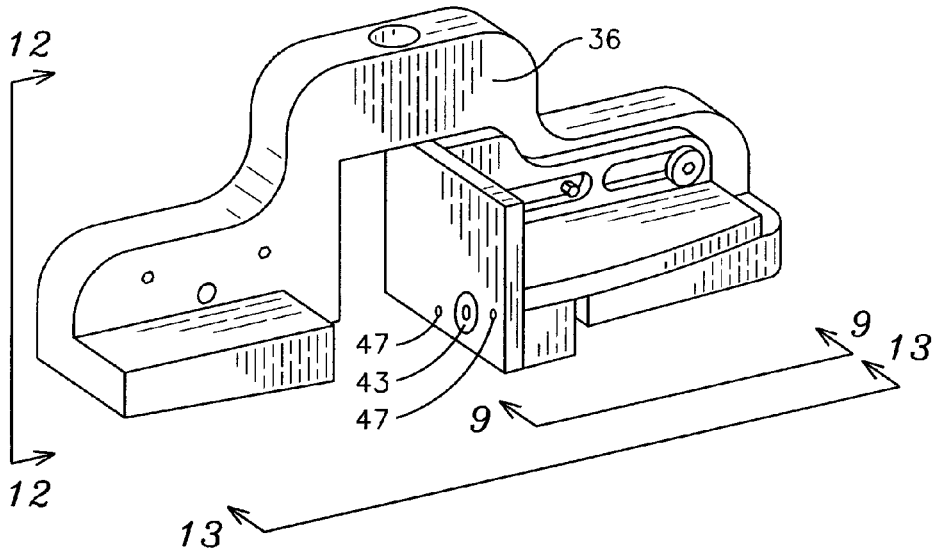
FIG. 7 depicts a rear perspective view of an exemplary embodiment of a putter head used in a system for training a golf club stroke.
Figure 8:
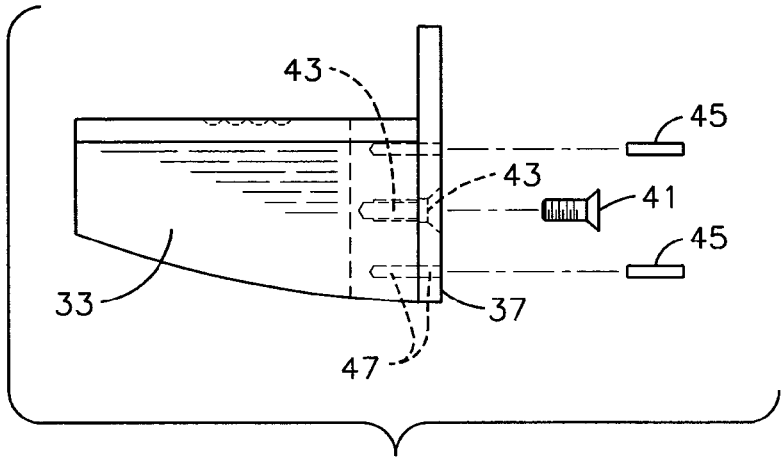
FIG. 8 depicts a top cross-sectional exploded view of a shield structure taken along the line 8-8 in FIG. 6.
Figure 9:
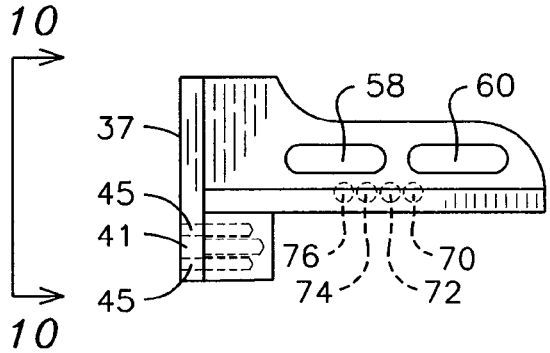
FIG. 9 depicts a side cross-sectional view of a shield structure taken along the line 9-9 in FIG. 7.
Figure 10:
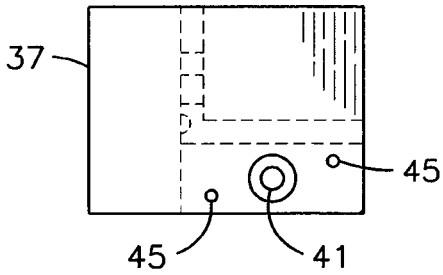
FIG. 10 depicts an end cross-sectional view of a shield structure taken along the line 10-10 in FIG. 9.

As illustrated in FIGS. 5 and 6, a pair of shield structures 32,34 extend from a rear face 36 of the putter head 26. Each shield structure 32,34 includes a shield base 33,35 slidably coupled to the rear face 36 of the head 26 and which extends along the rear face 36 of the head 26. Each shield structure 32,34 further includes a shield plate 37,39 coupled to the shield base 33,35, where the shield plate extends with a substantial perpendicular orientation from the rear face 36 of the head 26. However, the shield plate 37,39 may extend from the rear face 36 of the head 26 with an orientation other than perpendicular, or substantially perpendicular, provided that the shield plate 37,39 reduces the angular tolerance within which the laser 20 may transmit through the opening 28 to the laser sensor 18. As illustrated in FIGS. 8-10, the shield plate 37 is attached to the shield base 33 by passing a fastener 41 into a fastener aperture 43 within the shield base 33 and the shield plate 37, and by further passing a pair of stabilizers 45 into a respective pair of stabilizer apertures 47, also within the shield base 33 and the shield plate 37. The fastener 41 and stabilizers 45 are passed through the respective fastener aperture 43 and stabilizer apertures 47 in a direction parallel to the shield base 33, thereby securing the shield plate 37 to the shield base 33 in a substantial perpendicular orientation. The stabilizers 45 are included to provide additional structural support with the fastener 41. Although FIGS. 8-10 illustrate one fastener 41 and two stabilizers 45 utilized to secure the shield plate 37 to the shield base 33, any number of fasteners and/or stabilizers may be utilized. Additionally, although FIGS. 8-10 illustrate the structure of connecting the shield plate 37 to the shield base 33, a similar structure is utilized for connecting the shield plate 39 to the shield base 35.

As illustrated in FIGS. 6 and 9, the shield base 33 includes a pair of slots 58,60 oriented parallel to a base 62 of the head 26. The head 26 includes an aperture 64 aligned with each slot 58,60 when the shield base 33,35 is aligned with the rear face 36 of the head 26. The shield base 33,35 is slidably coupled to the rear face 36 of the head 26 once a fastener 66 is passed through each slot 58,60 and the aligned aperture 64 within the head 26. Although FIGS. 6 and 9 illustrate one aperture 64 of the head 26 aligned with each slot 58,60 of the shield structure 32, more than one aperture may be aligned with each slot. The fastener 66 is secured tight enough to rigidly attach the shield base 33,35 to the rear face 36 of the head 26, however the fastener 66 is not secured too tightly such that the shield base 33,35 may be slidably adjusted and each fastener 66 effectively moves from side to side of each respective slot 58,60.

Figure 12:
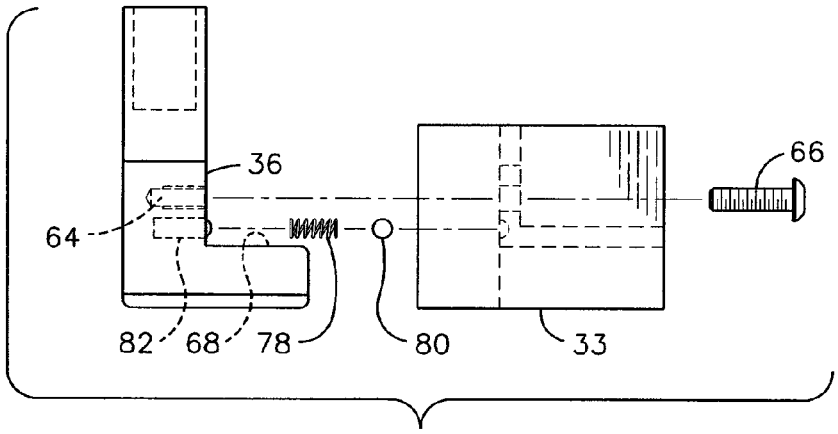
FIG. 12 depicts a side cross-sectional exploded view taken along the line 12-12 in FIG. 7.
Figure 13:
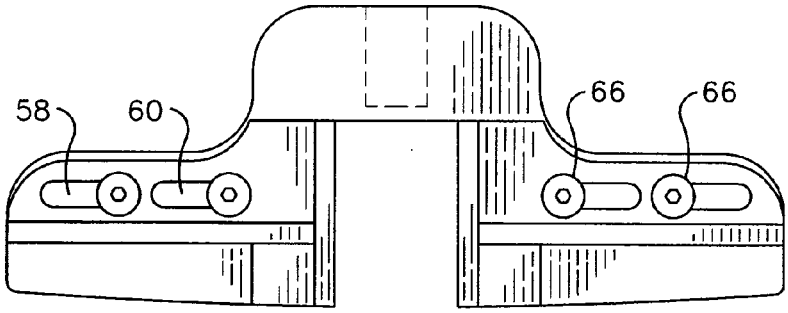
FIG. 13 depicts an end cross-sectional view taken along the line 13-13 in FIG. 7.

As further illustrated in FIG. 12, the rear face 36 of the head 26 includes a horizontal ledge 68 extending across the rear face 36 of the head 26. The shield base 33 is positioned on the horizontal ledge 68, and the shield base 33 is slidably coupled to the rear face 36 of the head 26 while positioned on the horizontal ledge 68. As stated previously, the opening 28 includes an adjustable dimension, and this adjustable dimension is varied by slidably adjusting the position of the shield bases 33,35 along the rear face 36 of the head 26. Upon slidably adjusting the position of the shield bases 33,35, the respective shield plates 37,39 connected to the shield bases 33,35 increase or decrease the width of the opening 28, based upon whether the shield bases 33,35 diverge or converge, respectively. However, the adjustable dimension of the opening 28 (ie. width), may be adjusted by any adjustable structure other than the shield structures 32,34 including the shield bases 33,35 and the shield plates 37,39, provided that such adjustable structure reduces or increases the width of the opening 28 based on its controlled adjustment, which may be manual or automatic.

Figure 11:
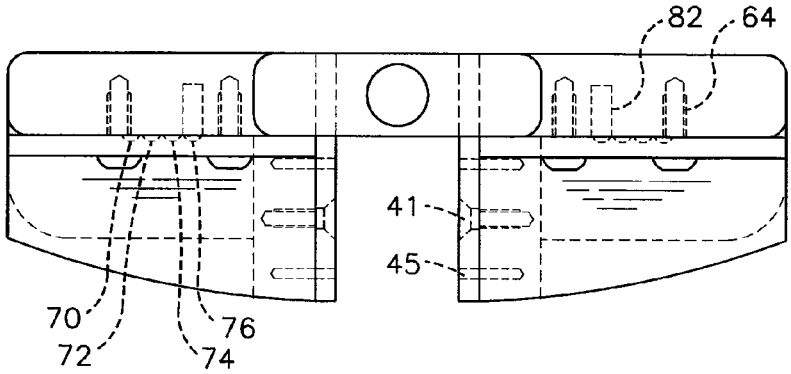
FIG. 11 depicts a top cross-sectional view taken along the line 11-11 in FIG. 6.

As illustrated in FIGS. 11-12, by adjustably sliding the shield base 33, the position of the shield base 33 is one of four incremental positions based upon four receptacles 70,72,74,76 along an inside surface of the shield base 33. A spring 78, followed by a ball 80 (ie. spring-loaded ball) are positioned within an opening 82 of the rear face 36, where the opening 82 is aligned with each of the four receptacles 70,72,74,76 as the shield base 33 adjustably slides along the rear face 36. The spring-loaded ball 80 is configured to release into one of the receptacles 70,72,74,76 at one of four incremental positions. Such incremental positions may refer to the width dimension of the opening 28, such as full width (ie. receptacle 76), ¾ width (ie. receptacle 74), ½ width (ie. receptacle 72), and ¼ width (ie. receptacle 70), for example. Although FIG. 11 illustrates four receptacles 70,72,74,76 and four incremental positions, any number of receptacles and any number of incremental positions (or none) may be utilized. Although FIGS. 11-12 illustrate a spring-loaded ball 80 to lock the shield base 33 in one of a number of incremental positions, any similar locking mechanism other than a spring-loaded ball structure may be utilized, provided that such locking mechanism effectively locks the shield base 33 into one of a number of incremental positions as it slides along the rear face 36 of the putter head 26.

When connecting the shield base 33 to the rear face 36, the spring-loaded ball 80 is first positioned within the opening 82, and the shield base 33 is aligned with the rear face 36 such that the spring-loaded ball 80 releases into the receptacles 70,72,74,76 as the shield base 33 slides along the rear face 36. Upon positioning the spring-loaded ball arrangement, the shield structure 32 is secured to the rear face 36 by passing the fasteners 66 through the slots 58,60 and the apertures 64 within the rear face 36. The position and structure of the shield base 35 is similar to the shield base 33, and thus requires no further discussion.

The user positions the putter 24 and the putter head 26 along the coupling member 12, such that the laser 20 transmits the laser beam 22 through the opening 28 in the putter head 26, and to the laser sensor 18. As illustrated in FIG. 1, the user positions the putter head 26 using the ball marking 11 along the coupling member 12, which is used to mark the relative position of a golf ball for proper address, and may be positioned at a center of the width and length of the coupling member 12, for example. Once the user has correctly positioned the putter head 26, and the laser beam 22 is received by the laser sensor 18, the user may initiate a golf club stroke, which is monitored by the system 10. During a correct golf putting stroke of the putter 24, the laser beam 22 will continuously pass through the opening 28 and into the laser sensor 18. Thus, during a correct golf putting stroke, including a correct take-away portion in which the user swings the putter back and a correct follow-through portion in which the user swings the putter forward through the ball position (ie. address position), the laser beam 22 continuously passes through the opening 28 and the laser sensor 18 continuously senses the laser beam 22.

The putter head 26 will accommodate shafts 25 of varying length, including standard length shafts, junior length shafts, and above-standard length shafts, as appreciated by one of skill in the art. These varying length shafts may be removably attached to the putter head. Additionally, the system 10 may accommodate putter heads of varying shape, provided that the putter head includes an opening through which the laser beam may pass to the laser sensor, as previously discussed.

In another embodiment of the present invention, a laser sensor may be positioned at the first and second end of the coupling member, while a laser may be attached the putter head. A first laser beam propagates along the take-away portion of the putting stroke, while a second laser beam propagates along the follow-through portion of the putting stroke. The sensors positioned at the opposing ends of the coupling member measure any variations of the laser beam from the target line.

As illustrated in the exemplary embodiment of FIG. 5, the head 26 further includes a non-transparent medium region 30, such as a metal based material, including stainless steel, for example. The opening 28 (or transparent medium region) is disposed between the non-transparent medium region 30. As illustrated in FIG. 5, the non-transparent medium region 30 is a metal-based material that forms the head 26, and is positioned on either side of the opening 28. During an incorrect golf putting stroke, in which the user either performs an incorrect take-away portion of the putting stroke or an incorrect follow-through portion of the putting stroke, the laser beam 22 is obstructed by the non-transparent medium 30 from passing to the laser sensor 18. Thus, during an incorrect golf putting stroke, the obstruction of the laser beam 22 caused by the non-transparent medium 30 causes a sensory disruption of the laser beam 22 by the laser sensor 18.

While the user performs a golf club stroke, the system 10 has an adjustable level of difficulty which corresponds to an adjustable angular tolerance of rotation of the putter head 26 in a plane perpendicular to the laser beam 22 along the coupling member 12 as the user performs each putting stroke. This angular tolerance may be adjusted by varying the separation of the shield bases 33,35 and correspondingly the shield plates 37,39, resulting in a variation in the width of the opening 28, as discussed above. For example, when a user first uses the system 10, they may adjust the separation of the shield bases 33,35 to a maximum separation, or a last incremental position using the last receptacle 76. This maximum separation, or last incremental position of the shield base 33,35 maximizes the separation and thus maximizes the width of the opening 28, thereby providing maximum angular tolerance of rotation of the putter head 26 during the putting stroke. As the user steadily improves their putting stroke with the system 10, they may decrease the separation of the shield bases 33,35, or to a first incremental position using a first receptacle 70. This minimum separation, or first incremental position provides minimum angular tolerance of rotation of the putter head 26 during the putter stroke. Although the shield bases 33,35 are shifted to incremental positions along the rear face 36, the shield bases may be continuously shifted to a continuum of positions along the rear face 36, and correspondingly locked in position at each position.

During use, the coupling member 12 should be positioned in an area without excessive direct sunlight or excessive external radiation. Such excessive sunlight or radiation may interference with the transmit-receive communication between the laser 20 and the laser sensor 18. Additionally, the system is not limited to use with putters, but may be used with other golf clubs, including woods and irons.

As further illustrated in the exemplary embodiment of FIG. 1, the system 10 may further include an alert indicator 46 positioned on the second housing 17 which houses the laser sensor 18. The alert indicator 46 is electrically coupled to the laser sensor 18. The laser sensor 18 sends a correct signal to the alert indicator once the user completes a correct putting stroke in which the laser sensor 18 continuously senses the laser beam 22. During an incorrect putting stroke, when the obstruction of the laser beam 22 to the laser sensor 18 causes a sensory disruption of the laser beam 22 by the laser sensor 18, the laser sensor 18 sends an incorrect signal to the alert indicator 46. The alert indicator 46 outputs either a correct indication using a green light 52 upon receiving the correct signal, or outputs an incorrect indication using a red light 54 upon receiving the incorrect signal. Although FIG. 1 illustrates an alert indicator including a green light and red light to indicate a correct putting stroke and incorrect putting stroke, any alert device may be utilized to indicate a correct putting stroke and/or incorrect putting stroke to the user, such as an audible alert indicator, for example.

In addition to alerting the user of the accuracy of each putting stroke, the system 10 may include a microprocessor 56, which is electrically coupled to the laser sensor 18, and is utilized to receive reception data from the laser sensor 18 for a number of putting strokes, and is further utilized to monitor one or more performance parameters of the golf putting strokes. For example, the controller may monitor the ratio of correct putting strokes to the total number of putting strokes during a fixed time, for example. The microprocessor 56 may be customized to provide statistics or data for any type of performance parameter that the user desires.

Figure 14:
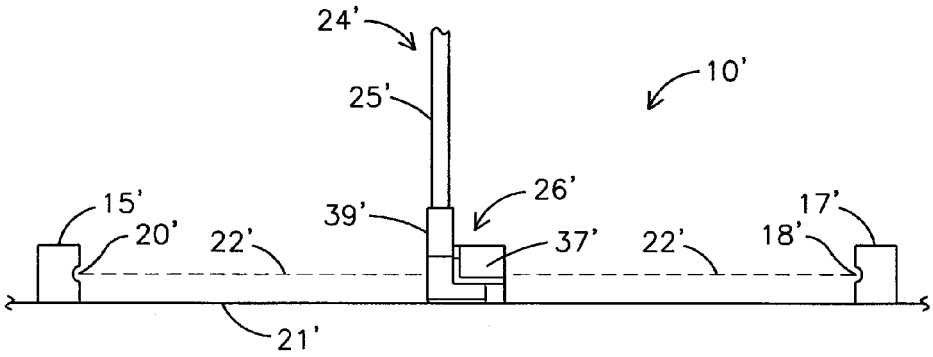
FIG. 14 depicts a side cross-sectional view of an exemplary embodiment of a system for training a golf club stroke.

Another embodiment of the present invention is illustrated in FIG. 14 and provides a system 10' for training a golf club stroke, without the use of the coupling member discussed in the above embodiments. The system 10' includes a laser sensor 18' positioned within a second housing 17', and a laser 20' positioned within a first housing 15', where the laser 20' is configured to transmit a laser beam 22' received by the laser sensor. Unlike those embodiments discussed above, the laser sensor 18' and the laser 20' may be positioned at any respective first and second location, where the first and second locations may be located along the floor 21' of a room, a vertical surface such as a baseboard, for example, an outdoor ground, or a combination thereof. In positioning the laser sensor 18' and the laser 20', their relative positioning is such that the alignment of the laser beam 22' from the laser 20' transmits straight into the laser sensor 18' when it is unobstructed. The system 10' further includes a putter 24' which includes properties similar to the putter 24 discussed in the above embodiments, and the correct putting stroke or incorrect putting stroke of the putter 24' is assessed using the same methodology as discussed in the previous embodiments. Those elements of the system 10' not discussed herein, are similar to those elements of the embodiments of the system 10 discussed previously, with prime notation, and require no further discussion herein. Although the illustrated exemplary embodiment of FIG. 14 illustrates a laser sensor, laser and laser beam, any sensor, transmitter and signal, of any frequency produced by the transmitter may be utilized which is capable of being received by a sensor and which is sufficiently collimated along the coupling member so to be utilized in accordance with the present invention.

Figure 15:
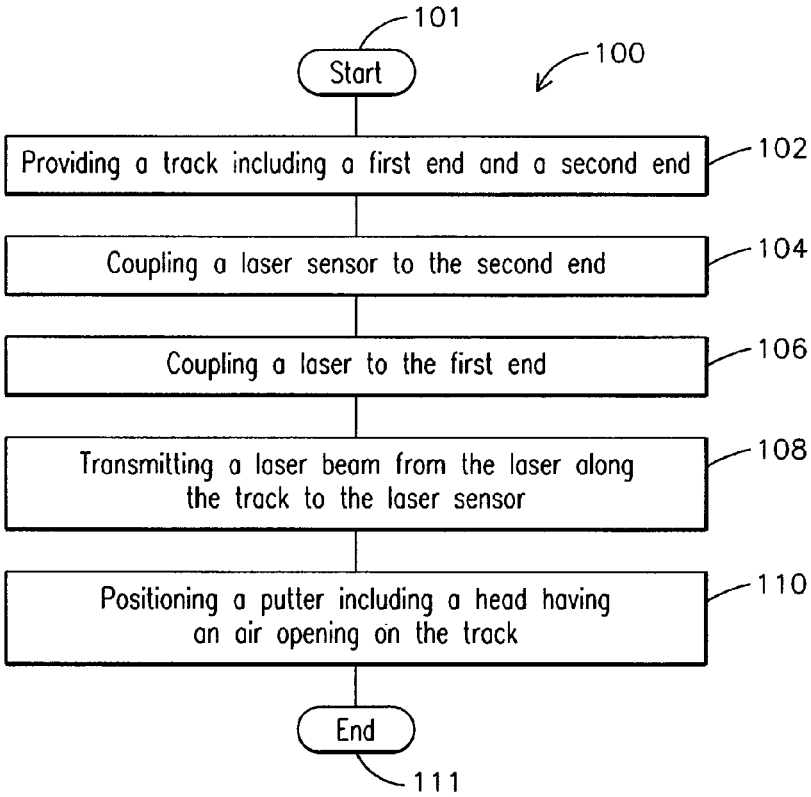
FIG. 15 depicts an exemplary embodiment of a method for training a golf club stroke.

FIG. 15 illustrates an exemplary embodiment of a method 100 for training a golf club stroke. The method 100 begins (block 101) by providing (block 102) a coupling member 12 including a first end 14 and a second end 16. The method 100 further includes coupling (block 104) a laser sensor 18 to the second end 16, followed by coupling (block 106) a laser 20 to the first end 14. The method 100 further includes transmitting (block 108) a laser beam 22 from the laser 20 along the coupling member 12 to the laser sensor 18. Additionally, the method 100 includes positioning (block 110) a putter 24 including a head 26 having an opening 28 on the coupling member 12, before ending at block 111.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A system for training a golf putting stroke, said system comprising:

a sensor;

a transmitter positioned in a spaced relation to the sensor, said transmitter configured to transmit a signal received by said sensor;

a putter comprising a head including an air opening with at least one adjustable dimension and a solid metallic material, said air opening disposed between the solid metallic material, said head positioned between said sensor and said transmitter, said signal configured to pass through said air opening; and a coupling member including a first end and a second end spaced apart from said first end, wherein said sensor is coupled to said first end, and said transmitter is coupled to said second end;

wherein during a correct golf putting stroke of said putter, said signal passes through said air opening to said sensor, and wherein during an incorrect golf putting stroke of said putter, said signal is obstructed by said solid metallic material from passing to said sensor.

2. The system of claim 1, further comprising a pair of shield structures configured to extend from a rear face of said head.

3. The system of claim 2, wherein each shield structure comprises a shield base slidably coupled to said rear face of said head and configured to extend along said rear face of said head, and each shield structure further comprises a shield plate coupled to said shield base, said shield plate configured to extend with a substantial perpendicular orientation from said rear face of said head.

4. The system of claim 3, wherein said shield base comprises at least one slot parallel to a base of said head, said head comprises at least one aperture aligned with a respective slot when said shield base is aligned with said rear face of said head, said shield base is slidably coupled to said rear face of said head upon passing at least one fastener through said at least one slot and said at least one aperture.

5. The system of claim 4, wherein said rear face of said head comprises a horizontal ledge extending across said rear face, said shield base positioned on said horizontal ledge, said shield base slidably coupled to said rear face while positioned on said horizontal ledge.

6. The system of claim 5, wherein said adjustable dimension of said opening is varied by slidably adjusting the position of said shield base along said rear face of said head;

said position of said shield base comprises at least one incremental position based upon at least one receptacle along an inside surface of said shield base and a spring-loaded ball positioned within an opening of said rear face, said spring-loaded ball is configured to release into one of said at least one receptacle at one of said at least one incremental position.

7. The system of claim 6, wherein said opening is a rectangular shaped opening, said at least one shield plate to vary the separation of said outside edges of said rectangular shaped opening.

8. The system of claim 6, wherein said slidable adjustment of said shield base and said adjustable width of said opening is configured to adjust the axial tolerance for said correct golf putting stroke in a direction perpendicular to said coupling member.

9. A system for training a golf putting stroke, said system comprising:

a sensor;

a transmitter positioned in a spaced relation to the sensor, said transmitter configured to transmit a signal received by said sensor; and a putter comprising a head including a transparent medium region, said head positioned between said sensor and said transmitter, said signal configured to pass through said transparent medium region;

a coupling member including a first end and a second end spaced apart from said first end, wherein said sensor is coupled to said first end, and said transmitter is coupled to said second end;

an alert indicator coupled to said sensor, wherein during a correct putting stroke of said putter, said signal passes through said transparent medium region to said sensor, said sensor is configured to continuously sense said signal, and said sensor is configured to send a correct signal to said alert indicator;

during an incorrect putting stroke of said putter, an obstruction of said signal to said sensor causes a sensory disruption of said signal by said sensor, said sensor is configured to send an incorrect signal to said alert indicator;

said alert indicator is configured to output a correct indication upon receiving said correct signal and output an incorrect indication upon receiving said incorrect signal.

10. The system of claim 9, wherein said correct indication is a first light with a first color, and said incorrect indication is a second light with a second color.

* * * * *